US005765326A

United States Patent [19]

Schuster

[11] Patent Number: 5,765,326

[45] Date of Patent: Jun. 16, 1998

[54] GLOBATED BUILIDING STRUCTURE

[76] Inventor: Siegfried Schuster, P.O. Box 1604, Kaneone, Hi. 96744

[21] Appl. No.: 584,150

[22] Filed: Jan. 11, 1996

Related U.S. Application Data

[63] Continuation of Ser. No. 137,949, Oct. 15, 1993, abandoned.

[51] Int. Cl.[6] ..... E04H 3/00

[52] U.S. Cl. ..... 52/236.2; 52/66; 52/81.2; D25/19

[58] Field of Search ..... 52/80.1, 81.1, 52/81.2, 81.3, 82, 236.2, DIG. 10, 66; D25/13, 19

[56] References Cited

U.S. PATENT DOCUMENTS

| | | | |
|---|---|---|---|
| 655,255 | 8/1900 | Lyouns | 52/81.1 |
| 2,166,577 | 7/1939 | Beckius | 52/81.2 |
| 3,916,578 | 11/1975 | Forootan | 52/81.2 |
| 4,067,153 | 1/1978 | Davis | 52/81.1 |
| 4,442,639 | 4/1984 | Lindsey et al. | 52/81.2 |
| 4,848,047 | 7/1989 | Sneyd | 52/81.2 |
| 5,325,642 | 7/1994 | Cooley | 52/81.1 |

FOREIGN PATENT DOCUMENTS

| | | | |
|---|---|---|---|
| 779577 | 11/1980 | U.S.S.R. | 52/81.2 |

OTHER PUBLICATIONS

Progressive Architecture: Jan. 1983 pp. 16–18.

*Primary Examiner*—Michael Safavi
*Attorney, Agent, or Firm*—Meroni & Meroni

[57] ABSTRACT

A spherical support structure is provided. The spherical support structure includes a plurality of interconnected rib structures defining a spherical shape. Each rib structure includes a vertical rib, horizontal members connected to the vertical rib, a plurality of exterior diagonal members extending diagonally outward from the rib structure for connection to other rib structures, and a plurality of internal diagonal members connected to the rib structure and extending diagonally between a spherical exterior shell and a spherical interior shell. The spherical exterior shell being connected to and enveloping the rib structures. The spherical interior shell being connected to the rib structures and forming spherical cavity therewithin. A plurality of floor structures are mounted to the horizontal members of the rib structures and are horizontally disposed between the spherical exterior shell and spherical interior shell.

5 Claims, 10 Drawing Sheets

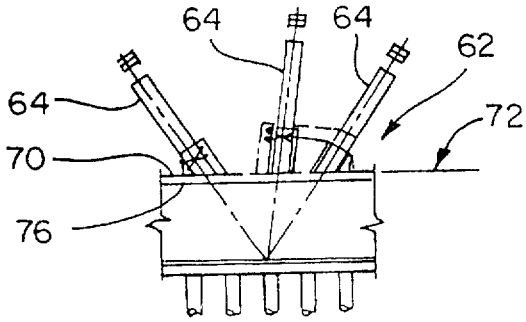
Fig. 7
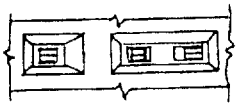
Fig. 8
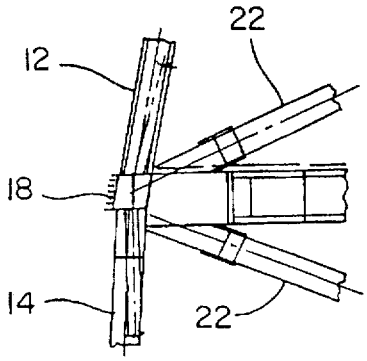
Fig. 9
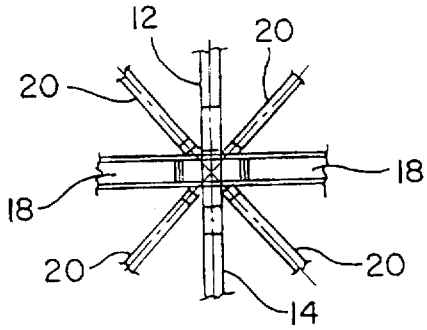
Fig. 10
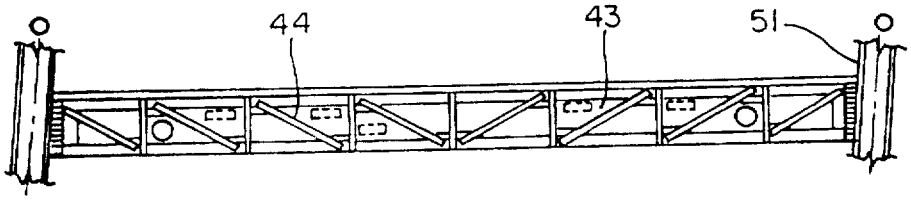
Fig. 11
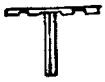
Fig. 12
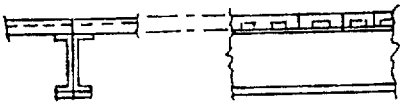
Fig. 13
Fig. 14
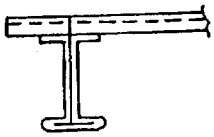
Fig. 15

GLOBATED BUILIDING STRUCTURE

This application is a continuation of application Ser. No. 08/137,949 filed on Oct. 15, 1993 now abandoned.

BACKGROUND OF THE INVENTION

1. Field of Invention

This invention relates to a building structure embodied in the external shape of a globe. This building structure is a unique structural design and incorporates the ability to provide an internal support structure, leaving the external surface smooth, unlike that of Geodesic structural design.

This invention includes certain claims of enhancements in the utility and design of a spherical building.

2. Description of Prior Art

Globe building structure design is already known and patented. Reference is made to U.S. Pat. No. 655,255, patented, Aug. 7, 1900. Herbert F. W. Lyouns, Inventor. Application filed Aug. 12, 1899.

The proposed building structure, while incorporating certain patented claims of the above referenced patent, will incorporate certain unique additional structure and utility features which should render the resulting structure worthy of patent.

SUMMARY OF THE INVENTION

This proposal describes a unique building construction utilizing the design of a sphere. The entire external shape is a globe. The purpose for this design is to take advantage of the aesthetic aspects of a globe or sphere. The shape is simplistic and clean in appearance.

Particularly appealing is to decorate the building exterior with the world map.

The structure of the building could use various methods to support the outer glove shell, depending on the size and application use of the building. The entire interior of the globe could incorporate a conventional building structure.

The interior wall structure of the building could incorporate one or more globes smaller in size inside the outer globe/globes which would constitute the inside walls of the building structure. This would be accomplished leaving any portion of the inside or center of the globe to provide the benefits of an internal atrium.

With the external wall of the building being the complete shell of the globe, entrance to the inside building could be through the base of the glove, or via an external tower with walkways connected to the Globe interior spaces. Conventional elevators to access each level would be positioned in elevator shafts structured as needed around the internal wall of the atrium, or elevator shafts incorporated in the floor structure inside the globe.

Another option would be to have external elevators proceed vertically up the outside curved surface of the globe, with entrances on the various levels. The building design could accommodate as many external elevators as required by the building application or use.

There could be variations and sizes for different applications of this building design. The support structure would seem to be the major limiting requirement to the utilization of this type of building.

The entire support structure would be inside the external shell of the globe and the base of the building. This would maintain the external surfaces of the building to be clean and unincumbered. The globe building would be an attractive landmark.

As an example of a proposed prototypical building design herein is describes the utility features of a world oriented educational theme attraction for the public.

The World From Within("World") prototype is planned as an universal, multi-use facility where international culture, technology, research and industry can be shared and exchanged.

The proposed world globe building would be constructed 560 ft. in diameter. The base of the building would be as small as structural requirements permit, thus making the building a large free standing "World Globe". The external shell of the globe would be the world map on a glass shell skin.

The useable building structure should gave a minimum of 25 levels to house approximately 150 pavillions representing 150 countries of the world. The location of each country's pavillion could be at its external location of the globe, where practical.

Each pavillion would be specially designed in the decor of the nation represented. A country's pavillion would highlight its culture, world contributions, its history and scenery emphasizing any unique "flora and fauna", as well as weather characteristics. Also depicted would be any dangers to the world environment or any other unique affects the country would have on the world as a whole.

Aside from the pavillions, the top interior surface of the globe would house a series of large screen theaters utilizing the inner surface of the outer shell as extremely large curved screens. These theaters would run special showings of feature programs of interest to the whole world population.

Of particular interest would be a Carl Sagan type presentation of the beginning of the universe, or the astronomy of the solar system, or a presentation of views from a trip on a shuttle flight circumventing the world in orbit from outer space.

An atrium would be designed to utilize the interior space of the globe for interior aesthetics and multifunctional use. It is conceivable the North Pole section of the globe could be partially opened and closed like some covered stadiums presently in existence. This would enhance the possibilities of growing interior flora and fauna. Also incorporated would be an oculist view open area on each of the upper floors, so one could view the entire internal atrium to the base of the internal stadium.

The interior lower floor spaces of the globe building would provide adequate space for a large convention center with all necessary facilities and exhibit space.

Also a multifunctional sports stadium and theater would occupy the base of the internal Atrium.

The world oriented attraction would make this building complex especially attractive for business, cultural, environmental, educational, sports and other types of conventions.

External to the world globe structure, on the grounds, there would be adequate space for building the necessary concession shops, restaurants as well as motels and hotels to support the large numbers of visitors to "The World From Within".

To achieve the foregoing and other objectives, and in accordance with the purposes of the present invention a spherical structure is provided. The spherical support structure comprises a plurality of interconnected rib structures defining a spherical shape. Each rib structure includes a vertical rib, horizontal members connected to the vertical rib, a plurality of exterior diagonal members extending diagonally outward from the rib structure for connection to other rib structures, and a plurality of internal diagonal members connected to the rib structure and extending diagonally between a spherical exterior shell and a spherical interior shell. The spherical exterior shell being connected to and enveloping the rib structures. The spherical interior shell being connected to the rib structures and forming spherical cavity therewithin. A plurality of floor structures are mounted to the horizontal members of the rib structures and are horizontally disposed between the spherical exterior shell and spherical interior shell.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

In the drawings:

FIG. 7 is a partial side view of a foundation structure for the present invention;

FIG. 8 is a top view of FIG. 7;

FIG. 9 is a partial side view of a rib structure of the present invention;

FIG. 10 is a partial side view of a rib structure of the present invention;

FIG. 11 is a partial sectional side view of a floor structure of the present invention;

FIG. 12 is a sectional view of the floor structure of FIG. 11;

FIG. 13 is a sectional view of a wide flange steel beam support connection to a light weight concrete slab on the metal deck;

FIG. 14 is a partial side view of FIG. 13;

FIG. 15 is a partial sectional view of a slab edge connecting to the exterior/interior horizontal tie beam;

DETAILED DESCRIPTION OF THE PREFERRED EMBODIMENTS

STRUCTURAL SYSTEMS

Figure 1:
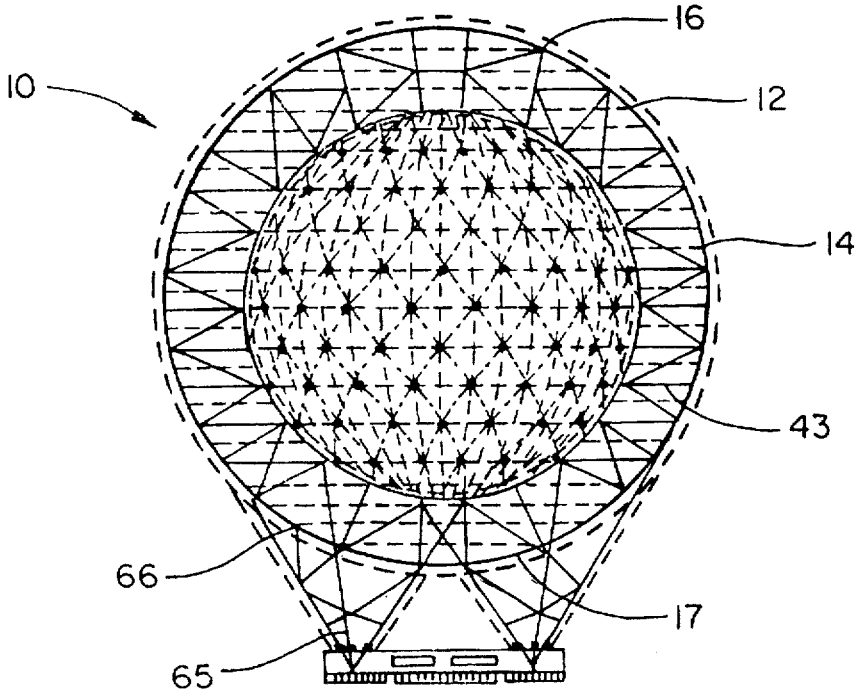
FIG. 1 is a sectional view of the present invention.

The following structural design is unique and provides the capability of the proposed building to have structural support heretofore unavailable. The proposed spherical building structure is an enhancement of previous inventions.

A. Preliminary Foundation System

The foundation system of the building will be founded on structural piles with 500 tons minimum capacity or deep caissons. The final bearing depths and pressures will be determined from the results of the geotechnical exploration program. A Post-tensioned reinforced concrete mat connecting the base supports is tied with grade beams at the center of the structure. Reinforced concrete mat is anticipated at the base of the elevator tower.

B. Superstructure

The "World From Within" (the "World") is a multi-use facility that houses approximately 3 million gross square feet of framed area for the use of world trade pavilions, hotel, observation decks, restaurants, entertainment facilities and mechanical spaces. The multifunctional design of this globular building is an enhancement to previous designed globular buildings.

The structure is enclosed between a 400' diameter interior shell and a 560' diameter exterior shell which contains the project program and forms a pure spherical shape. The interior shell encloses a 400' diameter atrium including a multi-purpose stadium at its base. The vertical transportation system of the project is accomplished from within the body of the sphere and through a free standing cantilever elevator tower. The elevator tower is a pyramid in shape and runs tangentially to the body of the building. The tower and the sphere with their own pure forms are joined by bridges that occur at multiple levels. The interplay of shapes and function of both the tower and the sphere produces an exotic structure of pure form and function. This is a further enhancement to previously designed globe type buildings.

1. Sphere Structure:

The Sphere system consists of 40 vertical ribs that are linked with a 400' diameter interior shell and a 560' diameter exterior shell to form the main lateral and gravity load resisting system. Exterior and interior shells are composed of main vertical ribs, horizontal ring ties, and exterior diagonal members. Interaction of the exterior and interior shells occurs through vertical and horizontal trusses to form a thick shell that inherently contributes to the overall strength and stability of the system. Exterior diagonalization of the shells is essential to force distribution and to improve the behavior of the system under unbalanced loading and lateral loads. This is a unique new design for the support of a globular type building.

a. To improve the efficiency of the structure, exterior horizontal tension ties will be post-tensioned to reduce the amount of structural steel and to control the gravity load deflection of the system. Exterior horizontal tension ties will be post-tensioned sequentially in a pattern to follow the construction sequence of the structure.

b. All compression members are assumed to be tied to the floor framing and can be designed for an unbraced length of one floor about their weak axis. The inherent rigidity of the floor and its connection to the main lateral load resisting system validates the assumption described above. The structural support of the building consists of built-up structural steel columns to form the continuation of the major structural ribs. Structural supports are bridged together to enhance their out-of-plane stability and to distribute the load between the structural supports under unbalanced loading.

c. All structural members are fireproofed with cementitious fireproofing.

d. Optimizing the structural use of the material, the following structural members are considered.

1) Base:

Built-up structural steel columns.

2) Vertical Chords of Interior and Exterior Shell:

Wide flange beams and built-up structural members.

3) Interior Diagonal Ribs:

Wide flange beams.

4) Interior/Exterior Horizontal Ties:

Wide flange beams and built-up members. Exterior horizontal ties are post-tensioned with high strength, low relaxation strands.

5) Interior/Exterior Diagonals of the Shell:

Structural steel tubes.

2. Elevator Tower:

The elevator tower consists of a braced tube system with mega columns at each corner of the square-based pyramid. The exterior diagonals are kept to a minimum to carry shear and gravity loads to the mega columns. Mega columns, horizontal ties, and interior framing of the tower are composed of prefabricated wide flange beams and built-up structural steel shapes.

a. All structural members are fireproofed with cementitious fireproofing.

C. Floor Framing

1. Sphere:

All framing members will be composite with 3" metal deck and 3¼" light weight (90 pcf) concrete topping. The metal deck is 3" deep phosphatized/painted composite metal deck. The floor framing consists of simple beam connections spaced at 10' on center. Floor framing sizes vary from W10 to W24 beams. Girders are composed of 72" deep structural composite floor trusses. Floor framing is fireproofed with cementitious fireproofing.

2. Elevator Tower:

Floor framing of the elevator tower consists of simple connection beams, deep two-way trusses to transfer the gravity load to the exterior stability and lateral load resisting system. The floor framing is organized in such a way to produce a diaphragm to tie all major structural members to transfer lateral forces to the major panel points of the lateral system.

Figure 2:
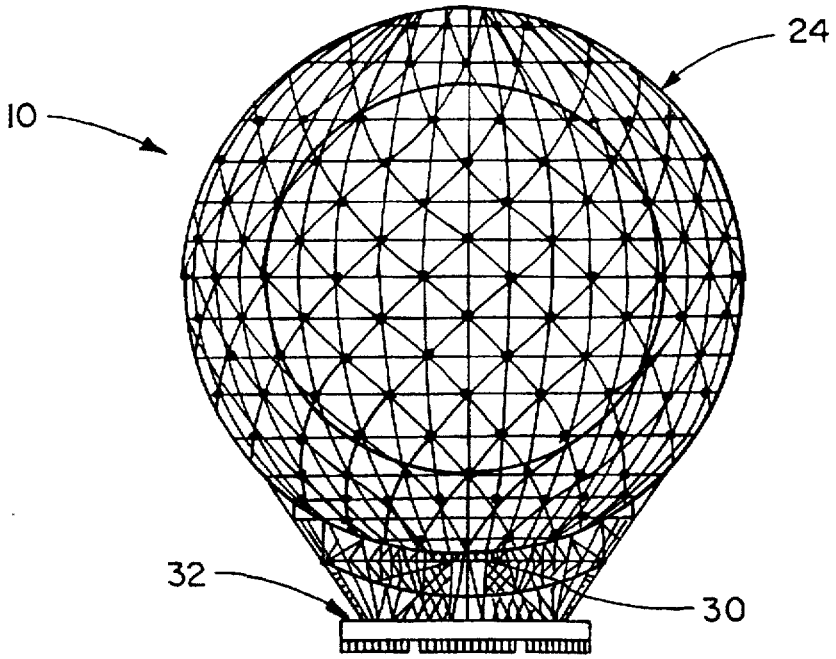
FIG. 2 is a side view of the present invention.
Figure 3:
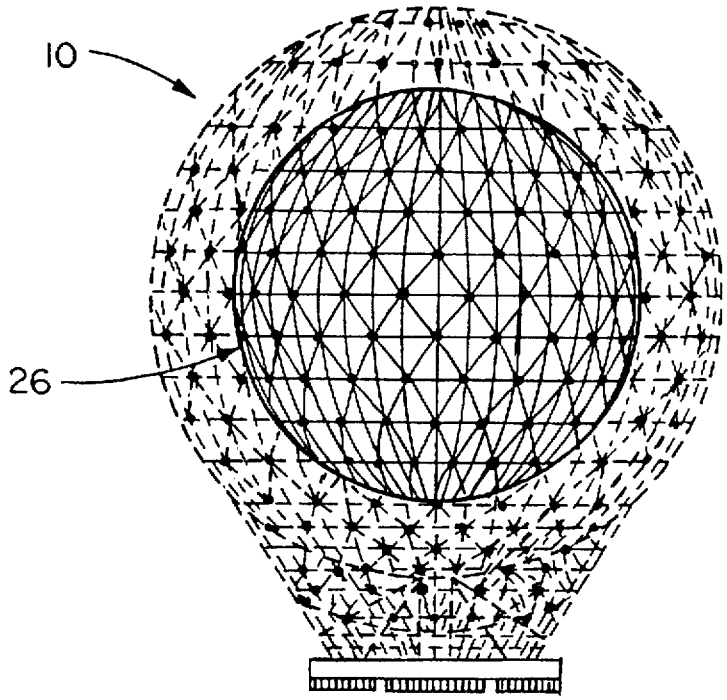
FIG. 3 is a sectional view of the present invention.

Referring now to the drawings, a spherical support structure 10 is shown in FIGS. 1–3. The spherical support structure 10 comprises a plurality of interconnected rib structures 12 defining a spherical shape. Each rib structure 12 includes a vertical rib 14 having a top end 16 and a bottom end 17, horizontal members 18 connected to the vertical rib 14, a plurality of exterior diagonal members 20 extending diagonally outward from the rib structure 12 for connection to other rib structures, and a plurality of internal diagonal 22 members connected to the rib structure 12 and extending diagonally between a spherical exterior shell 24 and a spherical interior shell 26.

As was previously stated, in a preferred embodiment, the spherical support structure is made up of 40 independent single rib structures 12. It should be understood that building techniques known to one skilled in the art are to be employed in the specific connections of the stated materials.

Figure 16:
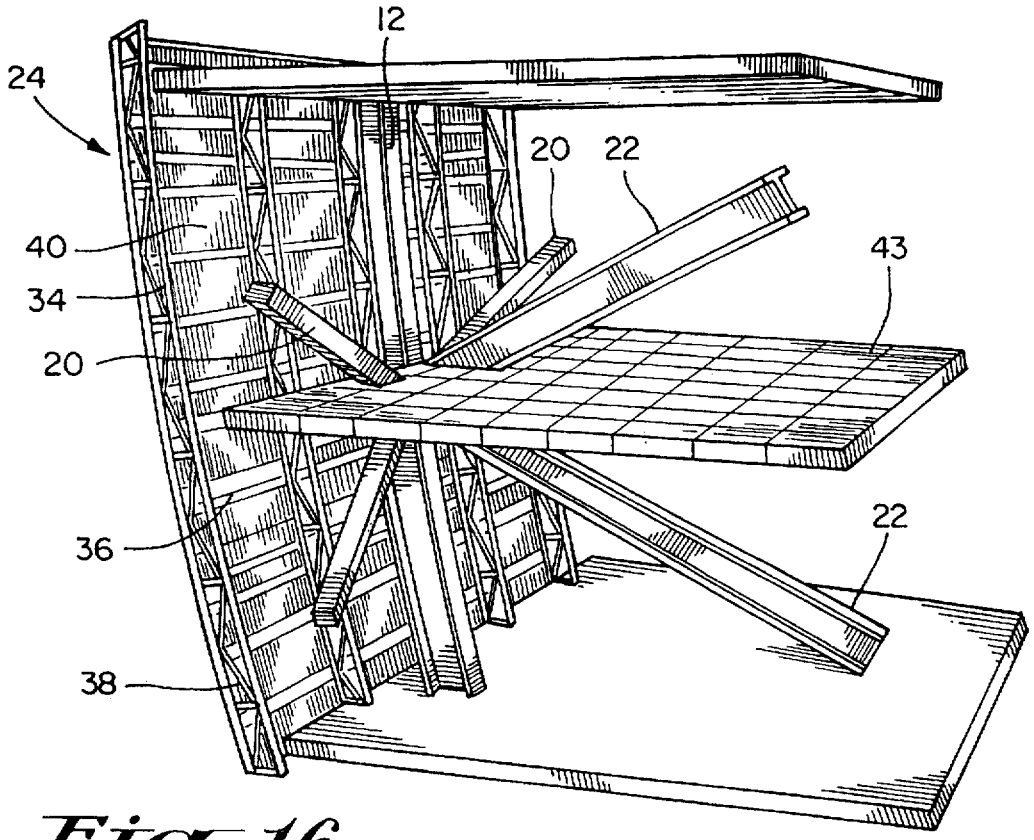
FIG. 16 is a partial perspective view of a rib structure of the present invention.
Figure 18:
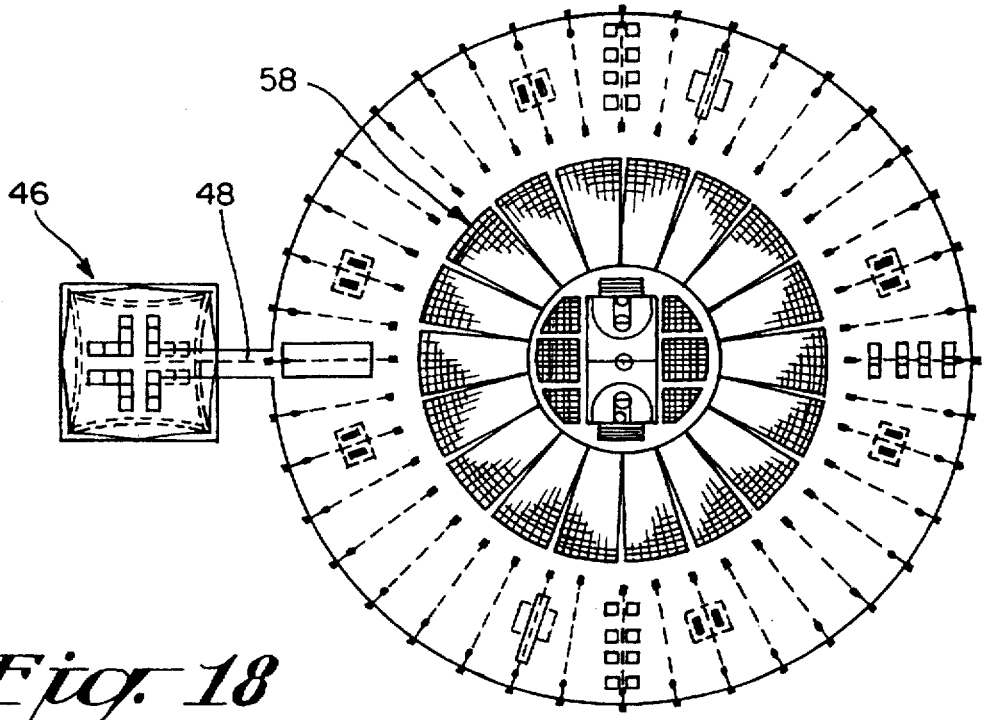
FIG. 18 is a sectional view taken along line 18—18 of FIG. 17.
Figure 17:
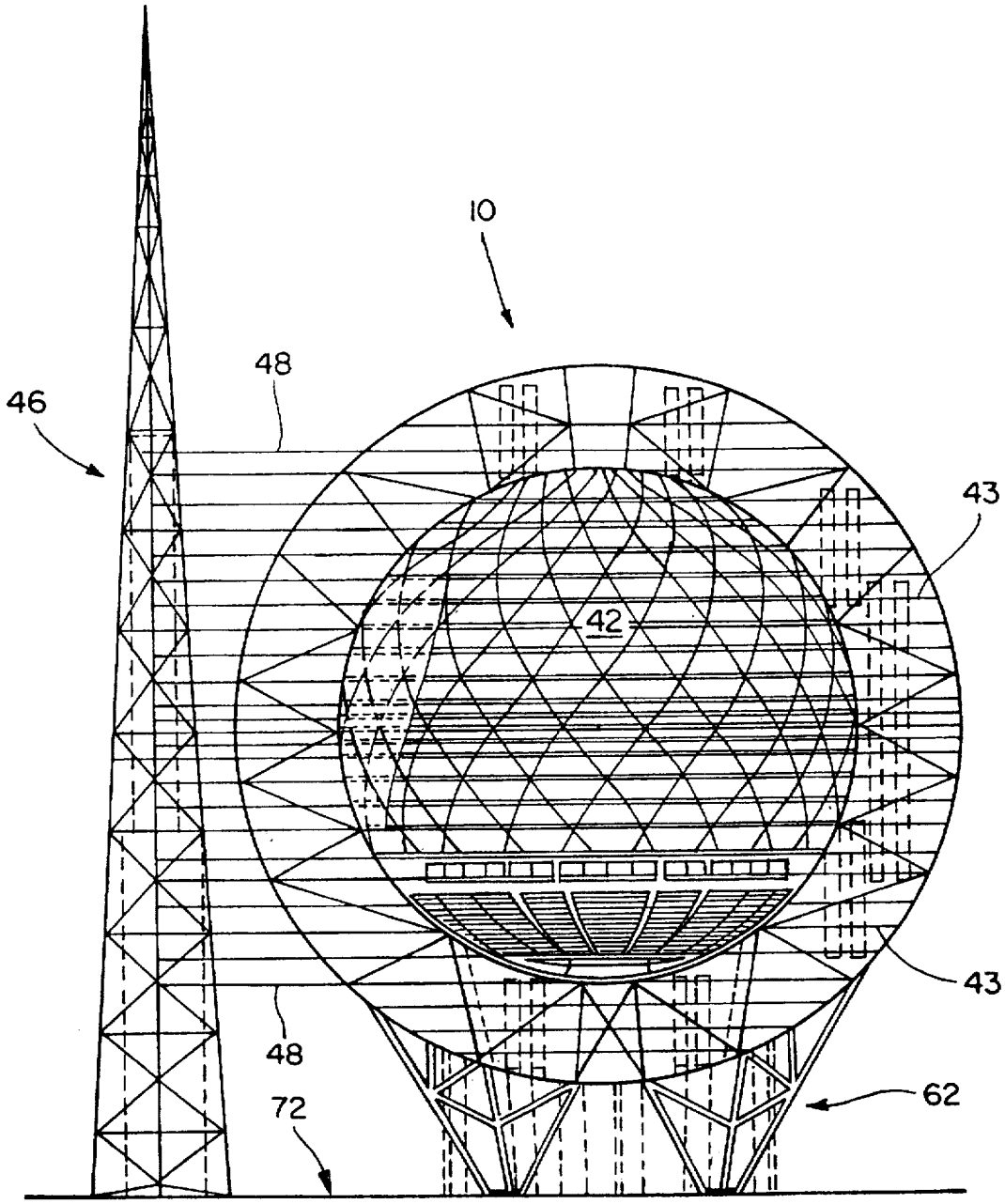
FIG. 17 is a side view of one embodiment of the present invention.

The spherical exterior shell 24 and spherical interior shell 26 include a support structure, as best illustrated in FIG. 16, having main vertical ribs 34, horizontal ring ties 36, and exterior diagonal members 38. Glass panels 40 or other suitable materials provide a skin for the shells. The spherical exterior shell 24 being connected to and enveloping the rib structures 12. The spherical interior shell 26 being connected to the rib structures 12 and forming spherical cavity 42 therewithin. The spherical exterior shell and spherical interior are connected to one another by the interconnected rib structures to form a free standing spherical structure, as previously described, having a center point common to both the spherical exterior shell and spherical interior shell. With respect to the center point, it should be understood that this term refers to that point equidistant from all points on the surface of a spherical body.

Referring to FIG. 11, a plurality of floor structures 43 are mounted to the horizontal members 18 of the rib structures 12, and shown in FIG. 16, and being horizontally disposed between the spherical exterior shell 24 and spherical interior shell 26. The floor structures 43 are made up of floor trusses 44 of conventional design, as best shown in FIG. 11.

A vertically extending external elevator tower 46, as previously described, is mounted adjacent to the spherical support structure 10. The elevator tower 46 has a plurality of horizontal passage structures 48 or bridges interconnecting between the elevator tower 46 and spherical support structure 10.

Figure 19:
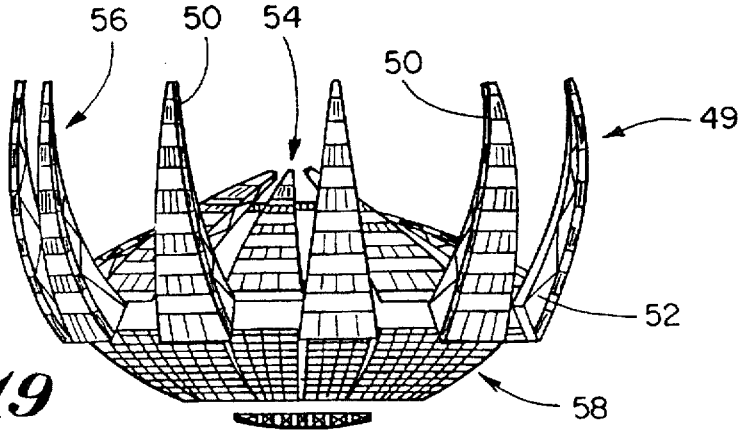
FIG. 19 is a perspective view of an annular roof structure of the present invention.
Figure 20:
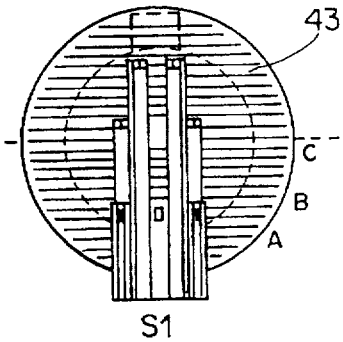
FIG. 20 is a sectional view of the present invention showing one embodiment for arrangement of a plurality of elevator passageways.
Figure 21:
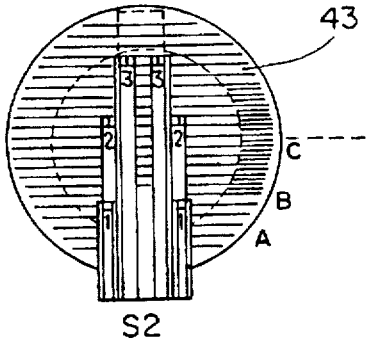
FIG. 21 is a sectional view of the present invention showing a second embodiment for arrangement of a plurality of elevator passageways.
Figure 22:
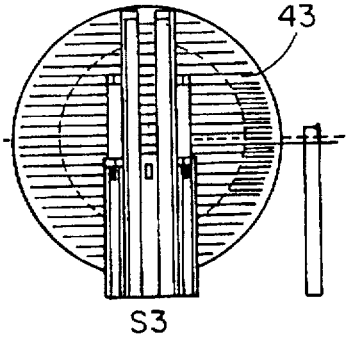
FIG. 22 is a sectional view of the present invention showing a third embodiment for arrangement of a plurality of elevator passageways.
Figure 23:
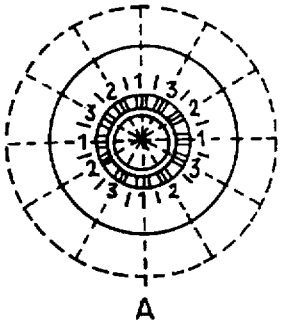
FIG. 23 is a sectional view taken along line 23—23 of FIGS. 20–21.
Figure 24:
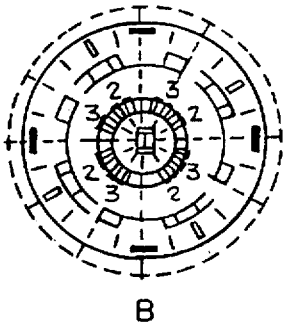
FIG. 24 is a sectional view taken along line 24—24 of FIGS. 20–21.
Figure 25:
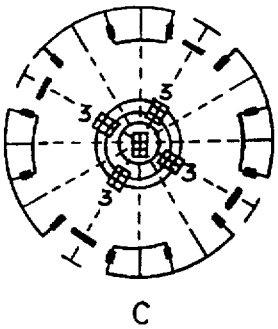
FIG. 25 is a sectional view taken along line 25—25 of FIGS. 20–21.
Figure 26:
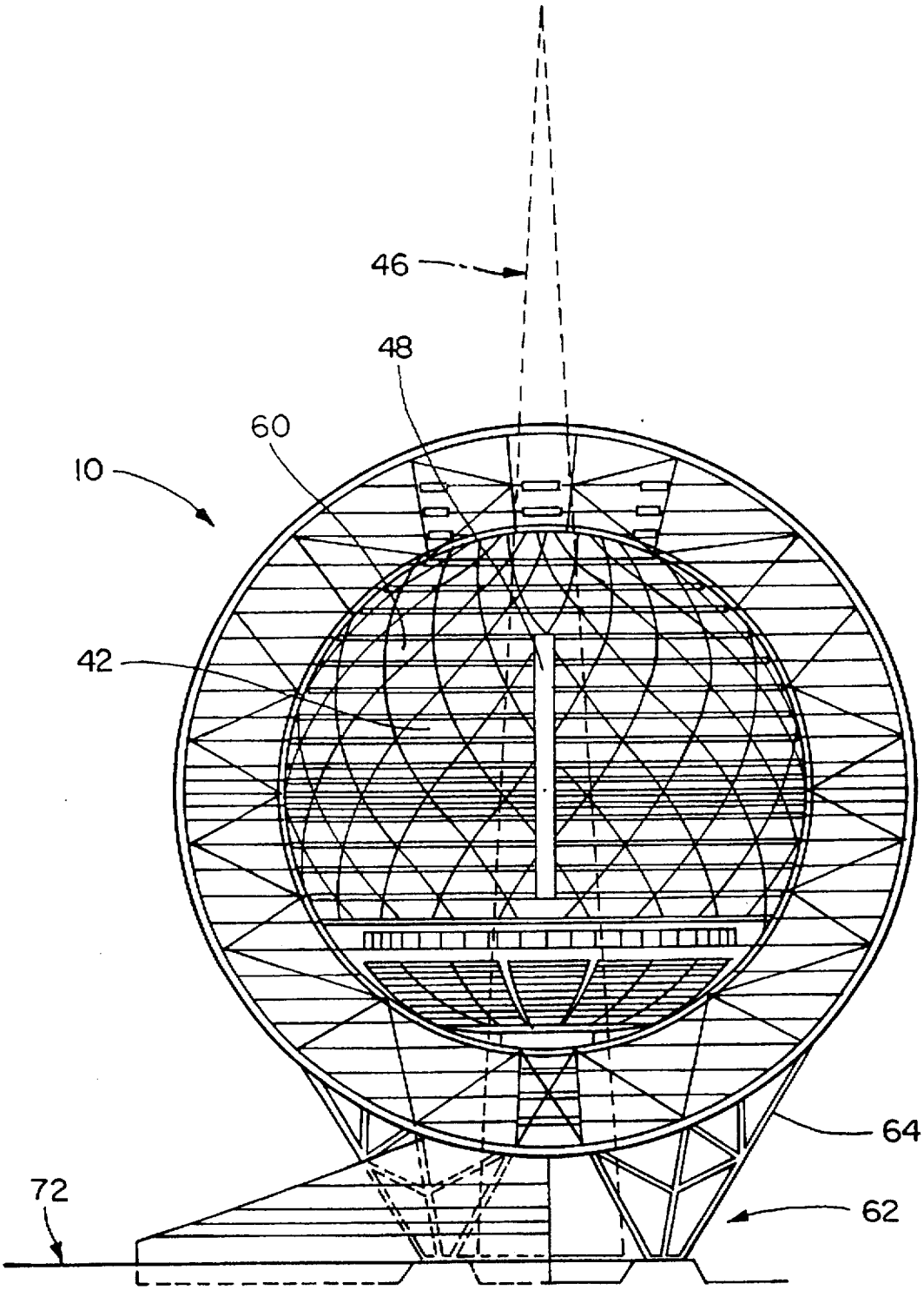
FIG. 26 is a side view of one embodiment of the present invention.
Figure 27:
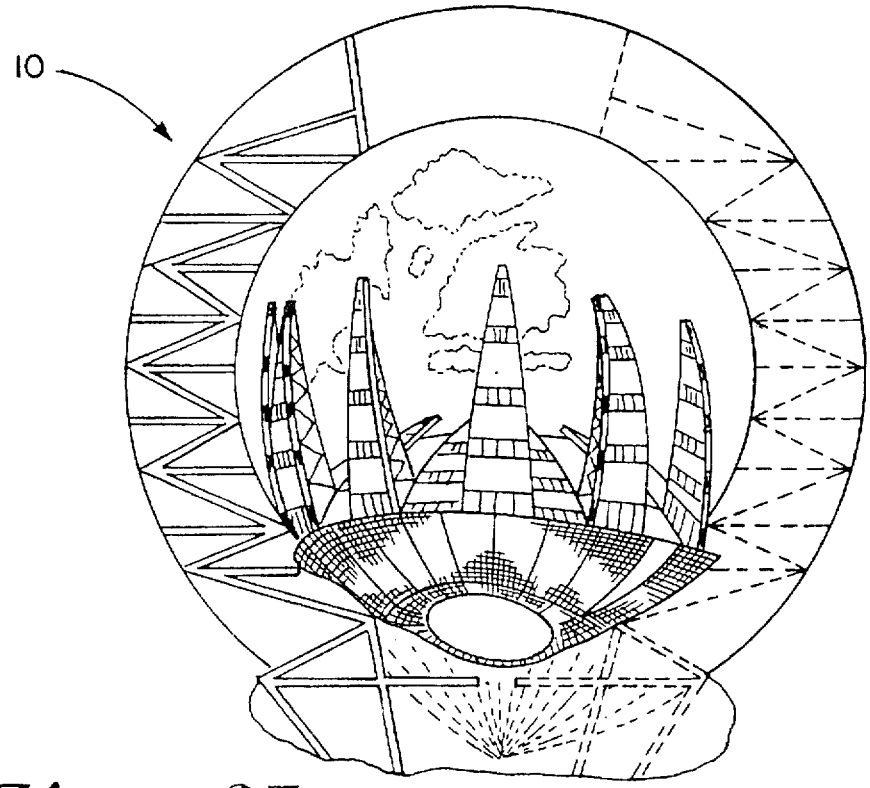
FIG. 27 is a perspective view of one embodiment of the present invention.
Figure 28:
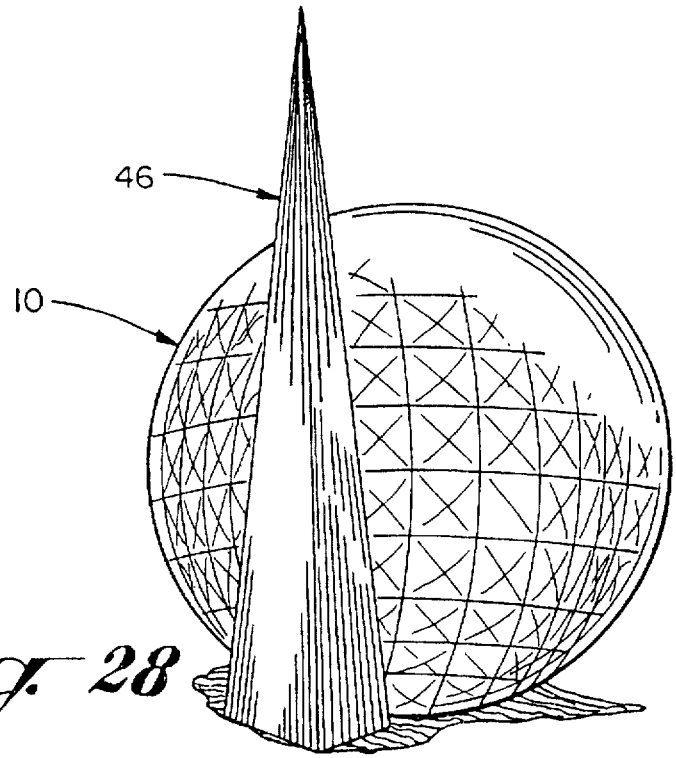
FIG. 28 is a perspective view of one embodiment of the present invention.
Figure 29:
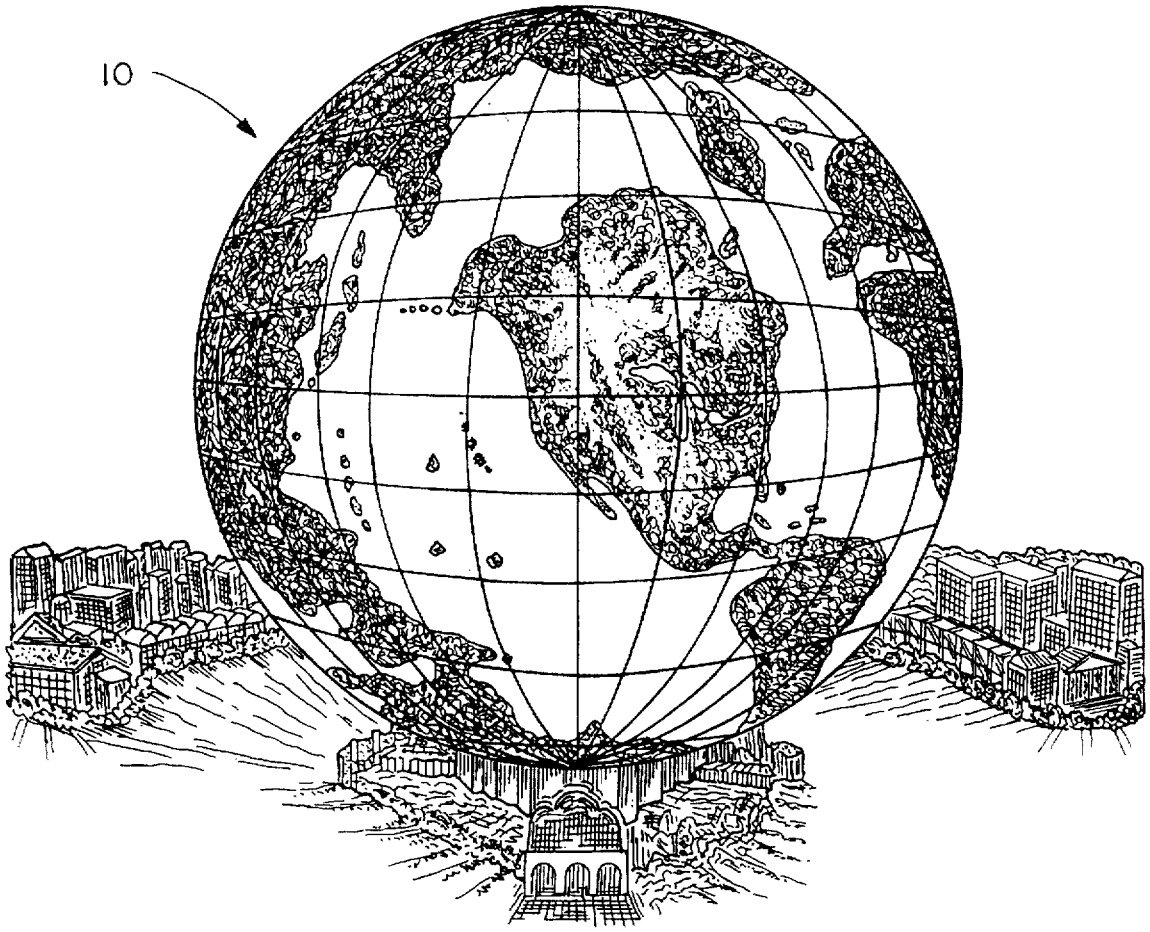
FIG. 29 is a perspective view of one embodiment of the present invention.

In an alternative embodiment, the spherical support structure 10 has an annular roof structure 49 mounted to an inner surface 51 of the spherical cavity 42. Referring to FIG. 19, the annular roof structure 49 includes a plurality of wedge shaped structures 50, pivotally mounted along a circumferential edge 52 of the annular roof structure 49. The wedge shaped structures 50 being positionable in a closed position 54 and an open position 56. In a closed position 54, the annular roof structure 49 will reduce sound produced in the below stadium 58 from entering into an upper spherical cavity portion 60.

Figure 4:
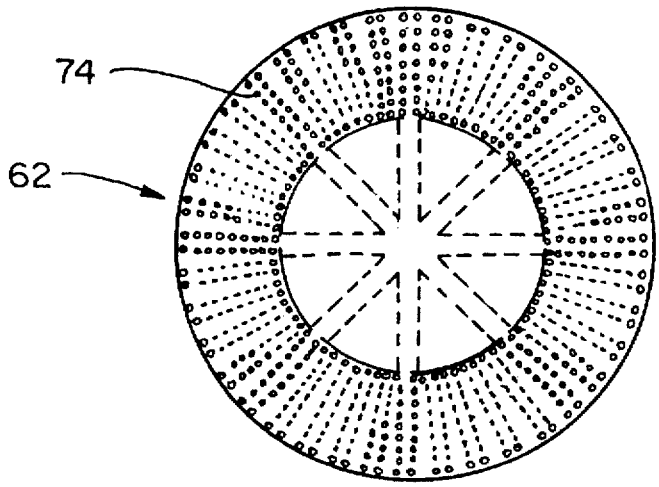
FIG. 4 is a plan view of a foundation for the present invention.
Figure 5:
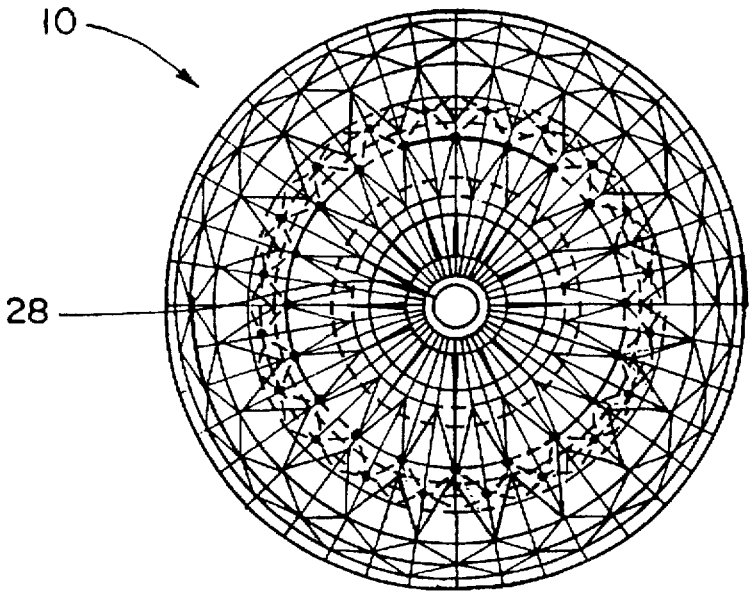
FIG. 5 is a top view of the present invention.
Figure 6:
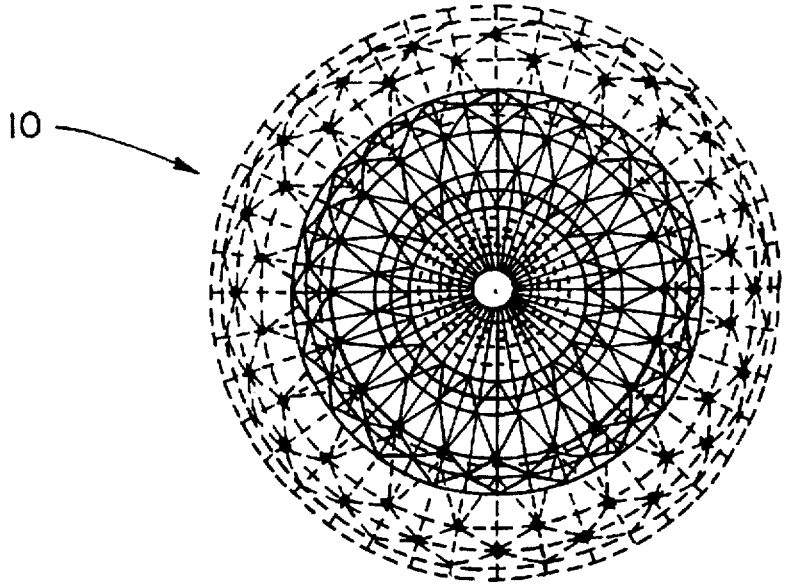
FIG. 6 is a sectional top view of the present invention.

To support the spherical support structure 10, a preliminary foundation system or foundation structure 62 is provided, as shown in FIGS. 4 and 7–8, so that the spherical shape is in a spaced apart relationship from the ground level. A plurality of base supports 64 or steel columns are provided having first ends 66 and second ends 68. The first ends 66 of the base supports 64 being connected to the vertical ribs 12. The seconds ends 68 of the base supports 64 being connected to a reinforced concrete mat 70. The reinforced concrete mat lying in a ground level plane 72 and being connected to a plurality of structural piles 74 which are vertically disposed on an underside 76 of the reinforced concrete mat 70, employing conventional foundation techniques.

The plurality of base supports 64 form a frame connected to the interconnected rib structures 12 for supporting the interconnected rib structures 12. As illustrated in the drawings, the frame is disposed at a lowermost portion of the spherical exterior shell 24 and had a width less than a diameter of the spherical exterior shell 24. Central and uppermost outer portions of the spherical exterior shell 24 remain free of encumbrance from the frame so that the structure 10 is free standing in an upright bulb-like fashion, as best illustrated in FIG. 2.

Although the invention had been described by reference to some embodiments it is not intended that the novel device be limited thereby, but that modifications thereof are intended to be included as falling within the broad scope and spirit of the foregoing disclosure, the following claims and the appended drawings.

I claim:

1. A free standing spherical support structure comprising:

(a) a plurality of interconnected rib structures defining a spherical shape, each rib structure including a vertical rib, horizontal members connected to the vertical rib, a plurality of exterior diagonal members extending diagonally outward from the rib structure for connection to other rib structures, and a plurality of internal diagonal members connected to the rib structure and extending diagonally between a spherical exterior shell and a spherical interior shell, the spherical exterior shell and spherical interior shell being connected to one another by the interconnected rib structures to form a self-supported spherical structure having a center point common to both the spherical exterior shell and spherical interior shell;

(b) the spherical exterior shell being connected to and enveloping the rib structures;

(c) the spherical interior shell being connected to the rib structures and forming a spherical cavity therewithin;

(d) a plurality of floor structures mounted to the horizontal members of the rib structures and being horizontally disposed between the spherical exterior shell and spherical interior shell; and (e) frame means connected to the interconnected rib structures for supporting the interconnected rib structures, the frame means including a plurality of base supports having first ends and second ends, the first ends of the base supports being connected to the interconnected rib structures, the seconds ends of the base supports extending downwardly and being connected to a reinforced concrete mat lying at ground level, the frame means being disposed at a lowermost portion of the spherical exterior shell and having a width less than a diameter of the spherical exterior shell, central and uppermost outer portions of the spherical exterior shell remaining free of encumbrance from said frame means.

2. The spherical support structure of claim 1, further comprising a vertically extending external elevator tower mounted adjacent to the spherical support structure, the elevator tower having a plurality of horizontal passage structures interconnecting between the elevator tower and spherical support structure.

3. A free standing spherical support structure comprising:

(a) a plurality of interconnected rib structures defining a spherical shape, each rib structure including a vertical rib, horizontal members connected to the vertical rib, a plurality of exterior diagonal members extending diagonally outward from the rib structure for connection to other rib structures, and a plurality of internal diagonal members connected to the rib structure and extending diagonally between a spherical exterior shell and a spherical interior shell, the spherical exterior shell and spherical interior shell being connected to one another by the interconnected rib structures to form a free standing spherical structure having a center point common to both the spherical exterior shell and spherical interior shell;

(b) the spherical exterior shell being connected to and enveloping the rib structures;

(c) the spherical interior shell being connected to the rib structures and forming a spherical cavity therewithin;

(d) a plurality of floor structures mounted to the horizontal members of the rib structures and being horizontally disposed between the spherical exterior shell and spherical interior shell; and (e) frame means connected to the interconnected rib structures for supporting the interconnected rib structures, the frame means including a plurality of base supports having first ends and second ends, the first ends of the base supports being connected to the interconnected rib structures, the seconds ends of the base supports extending downwardly and being connected to a reinforced concrete mat lying at ground level, the frame means being disposed at a lowermost portion of the spherical exterior shell and having a width less than a diameter of the spherical exterior shell, central and uppermost outer portions of the spherical exterior shell remaining free of encumbrance from said frame means.

4. The spherical support structure of claim 3, further comprising a vertically extending external elevator tower mounted adjacent to the spherical support structure, the elevator tower having a plurality of horizontal passage structures interconnecting between the elevator tower and spherical support structure.

5. The spherical support structure of claim 3, wherein the spherical cavity has a diameter of 400 feet and the spherical exterior shell has a diameter of 560 feet.

* * * * *